US008573235B2

(12) United States Patent
Hong

(10) Patent No.: US 8,573,235 B2
(45) Date of Patent: Nov. 5, 2013

(54) DINNERWARE MANAGEMENT SYSTEM WITH METHOD FOR CLEANING DISHWARE AND DISHWASHER EMPLOYING THE SAME

(76) Inventor: Shane Y. Hong, Taichung (TW)

( * ) Notice: Subject to any disclaimer, the term of this patent is extended or adjusted under 35 U.S.C. 154(b) by 333 days.

(21) Appl. No.: 13/008,752

(22) Filed: Jan. 18, 2011

(65) Prior Publication Data

US 2012/0180820 A1 Jul. 19, 2012

(51) Int. Cl.
*B08B 3/00* (2006.01)
*B08B 7/04* (2006.01)

(52) U.S. Cl.
USPC ..... 134/125; 134/124; 134/131; 134/132; 134/61; 134/65; 134/104.2; 134/104.4; 134/56 D; 134/57 D; 134/58 D; 134/105

(58) Field of Classification Search
USPC ..... 134/57 D, 56 D, 58 D, 61, 65, 94.1, 134/104.2, 104.4, 105, 124, 125, 131, 132
See application file for complete search history.

(56) References Cited

U.S. PATENT DOCUMENTS 3,040,874 A * 6/1962 Lyman ..... 198/793
3,075,215 A * 1/1963 Marue ..... 15/77
5,329,952 A 7/1994 Kojima et al.
5,497,798 A 3/1996 Fritz et al.
5,566,695 A * 10/1996 Levey et al. ..... 134/83

FOREIGN PATENT DOCUMENTS

JP 11019020 A * 1/1999
JP 2002086091 A * 3/2002
JP 2002200022 A * 7/2002
JP 2004008319 A * 1/2004
JP 2004148044 A * 5/2004
JP 4105752 B1 * 6/2008
JP 2009006072 A * 1/2009

* cited by examiner

*Primary Examiner* — Alexander Markoff
(74) *Attorney, Agent, or Firm* — Browdy and Neimark, PLLC

(57) ABSTRACT

A method for cleaning dinnerware includes the steps of aligning and/or registering items to be cleaned from a standby zone, moving the items continuously from the standby zone one by one into a wash zone in a way that the items each have a cleaning posture relative to a path along which the items march, washing the items processionally by using cleaning fluid, and sorting or collecting the items in order for reuse by diners directly. The dishwasher employing the aforesaid method has functions of auto-collecting and washing the to-be-cleaned dinnerware and sorting or collecting thus obtained dinnerware, and is compact in size such that the dishwasher can be directly installed at a location in proximity to a dining area for enabling the diners to conveniently take out the newly cleaned dinnerware at any time. The dishwasher has a good cleaning efficiency and a low operating cost.

9 Claims, 11 Drawing Sheets

DINNERWARE MANAGEMENT SYSTEM WITH METHOD FOR CLEANING DISHWARE AND DISHWASHER EMPLOYING THE SAME

BACKGROUND OF THE INVENTION

1. Field of the Invention

The present invention relates generally to a system for auto-cleaning to-be-cleaned items such as dining ware items and a dishwasher employing the same.

2. Description of the Related Art

Dishwashers used in business places usually need to wash a great amount and many kinds of dining ware items everyday. According to different cleaning requirements and wont operations, various kinds of commercially available dishwashers have been developed. For example, U.S. Pat. No. 5,329,952 disclosed an apparatus for washing dishes, which comprises racks for accommodating dishes to be washed, a rack carry-in unit for carrying the racks with the to-be-washed dishes into a washing tank, and a lifter unit for forwarding the racks with the dishes after completion of washing in the washing tank to a wagon, which is to be moved by an employee to a desired location for the purpose of reuse of the cleaned dishes after completion of loading of the racks therein. U.S. Pat. No. 5,497,798 disclosed a conveyer dishwasher, which uses spray nozzles to spray a sufficient amount of high pressure and high temperature cleaning fluid on to-be-cleaned dishes or dining bowls which are placed on a continuously operating conveyer so as to meet the need of cleaning a substantial quantity of dinnerware.

The above-mentioned conventional dishwashers usually occupy a large installation space in order to arrange the mechanisms of dinnerware conveying, cleaning and drying. Therefore, they are not suitable to be used in a small restaurant or in a place having a high space cost. In addition, these conventional dishwashers are usually installed inside the kitchen, resulting in that employees need to collect soiled dishes from a dining area in advance, and then place the to-be-cleaned dishes in the rack or on the conveyer one by one, and finally take the dishes after completion of washing and drying out of the dishwashers for reuse. The whole washing process is time-consuming, thereby increasing the cost of labor.

In addition, referring to FIG. 11, the conventional dishwashers 1 installed inside the kitchen are usually kept a certain distance from the place where the dishes are actually used; therefore, used dishes will be firstly collected at a storage place 2, and when the dishes are accumulated to a certain extent, the accumulated soiled dishes will then be moved by employee at one time to the dishwashers for cleaning. In this way, the food debris remained on the dishes tends to become hardened and to be stuck on the to-be-cleaned dishes when the dishes wait for washing at the storage place 2. As a result, a great amount of strong cleaning fluid may need to be used to clean the to-be-cleaned dishes completely, increasing the cost of washing, violating the requirement of environment protection and increasing the possibility of contamination of dishes.

SUMMARY OF THE INVENTION

The present invention has been accomplished in view of the above-noted circumstances. It is therefore one object of the present invention to provide a new concept of dinnerware management, including a method and a dishwasher for automatic cleaning dinnerware with features that patron can take clean dishes from the machine and put the used dishes back to the machine without the need of restaurant employee handling. The dishwasher is suitable to be installed at a location adjacent to the place where the dinnerware is actually used other than the kitchen so as to lower the operating costs including the rent for space and the cost of labor.

Another object of the present dishware management system invention is to provide a method for automatically cleaning dinnerware and a dishwasher employing the aforesaid method, wherein the dishwasher has a good cleaning efficiency, a small size, and cleaning, drying and sorting functions so as to protect environment.

To achieve the above-mentioned objects, the present invention provides a method for cleaning dinnerware comprising the steps of a) putting items to be cleaned in a standby zone that provides self-aligning and/or registering capability, b) moving the items continuously one by one from the standby zone into a wash zone in a way that the items each have a cleaning posture relative to a path along which the items march, c) washing the items processionally by using cleaning fluid, and d) sorting and/or collecting the items in order for reuse, such that diners can directly pick up the items for use.

The present invention also provides a dishwasher employing the above-mentioned method, which comprises a housing, a rail and at least one feeding unit. The housing has an entrance, an exit and a passage between the entrance and the exit. The rail passes through the entrance, the passage and the exit of the housing. The feeding unit extends along an axial direction parallel to the rail and has a helical guide groove about the axial direction. The feeding unit is rotatably disposed in the passage.

In order to cleaning the dinnerware completely, the housing may comprise two compartment plates spacedly disposed in the passage such that the passage is segmented into a wash zone in proximity to the entrance, a drying zone in proximity to the exit, and a rinse zone between the wash zone and the drying zone. Each one of the wash and rinse zones is installed with at least one first spray washing unit, and the drying zone is installed with a drying unit.

In order to improve and integrate the functions of the dishwasher, the dishwasher may further comprise a sorting device including a dispensing member, a turning unit and a collection tray/bin. The dispensing member has various grooves or guiding topography for fitting dining bowls or cups having different sizes. The dining bowls or cups that have been cleaned will be forced into the dispensing member and then moved along a predetermined path to enable the dining bowls to move to the turning unit and the cups to move to the collection tray/bin. In addition, the dishwasher of the present invention may further comprise a water collecting tank, which is capable of conducting heat exchange and separating oil from water. The water tank can collect the used water after it has been filtered so that the water can be re-used for washing dinnerware. The tank also exchanges the heat energy of the hot waste water leaving the tank to the incoming fresh water for rinsing and washing.

The present invention also provides a dishwasher management system employing the above-mentioned method, which comprises the above-mentioned dishwasher, a food providing area and a dining area. The to-be-cleaned dishware that is used by diners is placed at the standby zone abutted with the entrance of the dishwasher and the cleaned dishware is collected at a place abutted with the exit of the dishwasher. The food providing area is arranged neighbored to the exit of the dishwasher for enabling the diners to directly take the cleaned dishware from the dishwasher for holding food in the food providing area. The dining area is arranged between the food providing area and the exit of the dishwasher for enabling the diners to directly place the to-be-cleaned dishware that is used by the diners at the standby zone.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
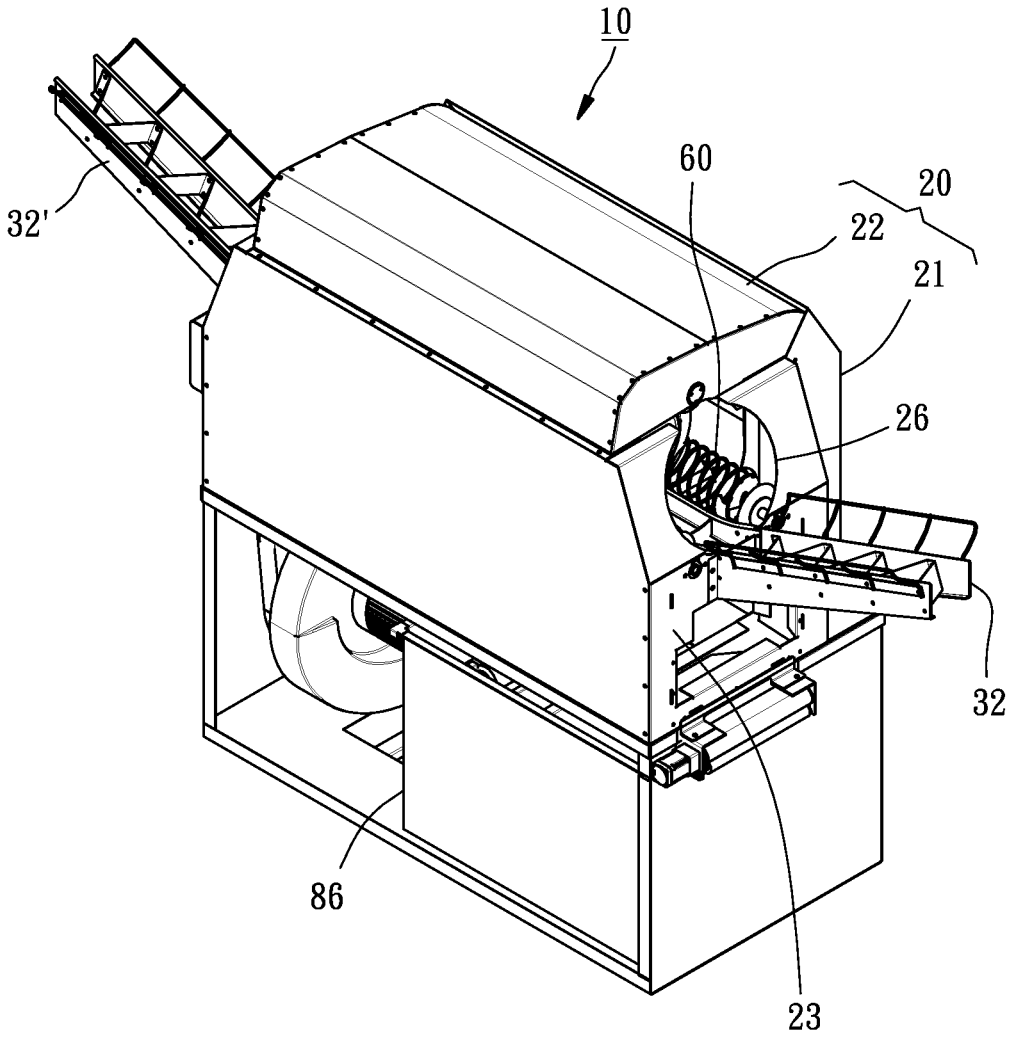
FIG. 1 is a perspective view of a dishwasher employing the method for cleaning dinnerware in accordance with a preferred embodiment of the present invention.
Figure 2:
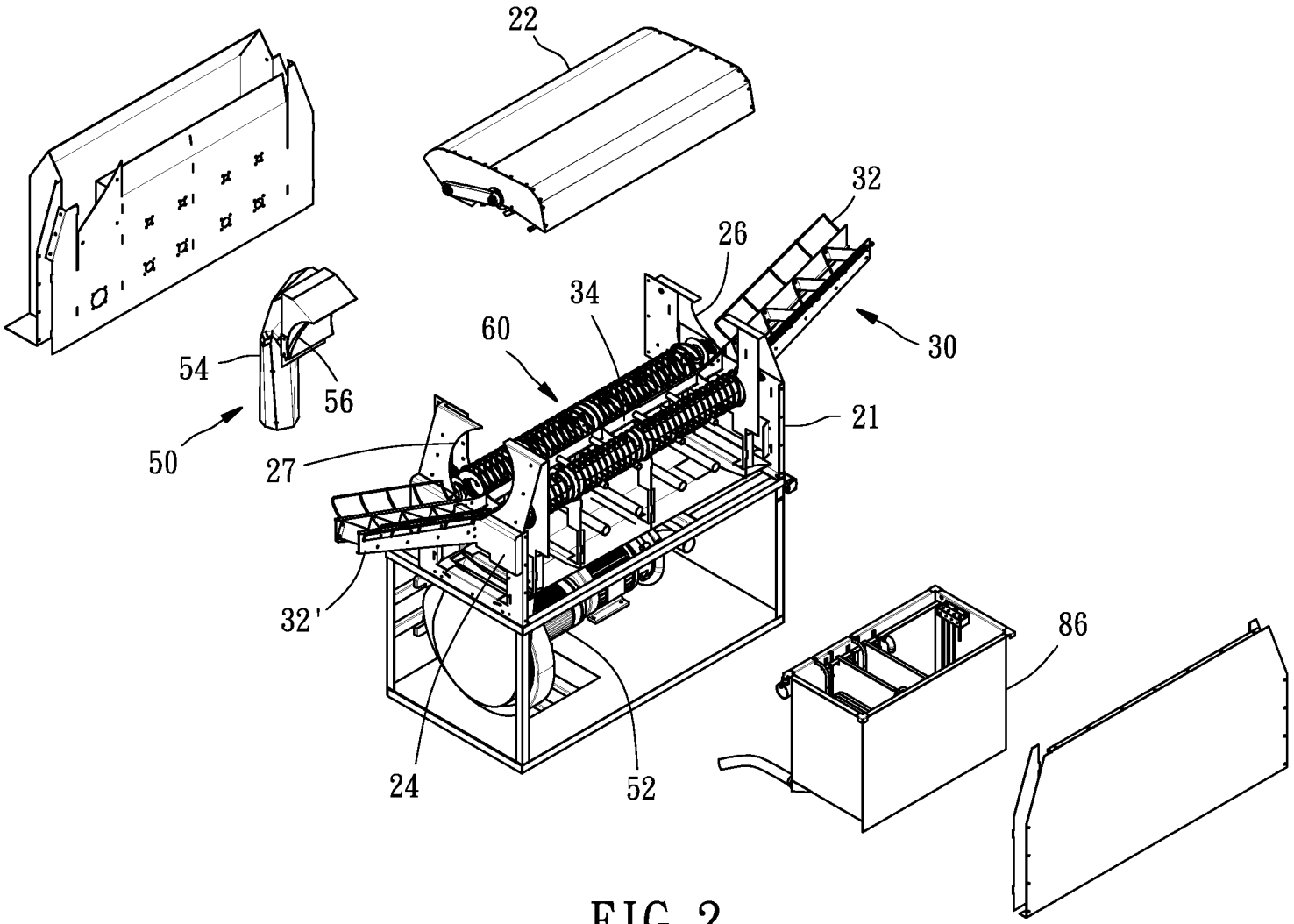
FIG. 2 is an explored view of the dishwasher of the preferred embodiment of the present invention.
Figure 3:
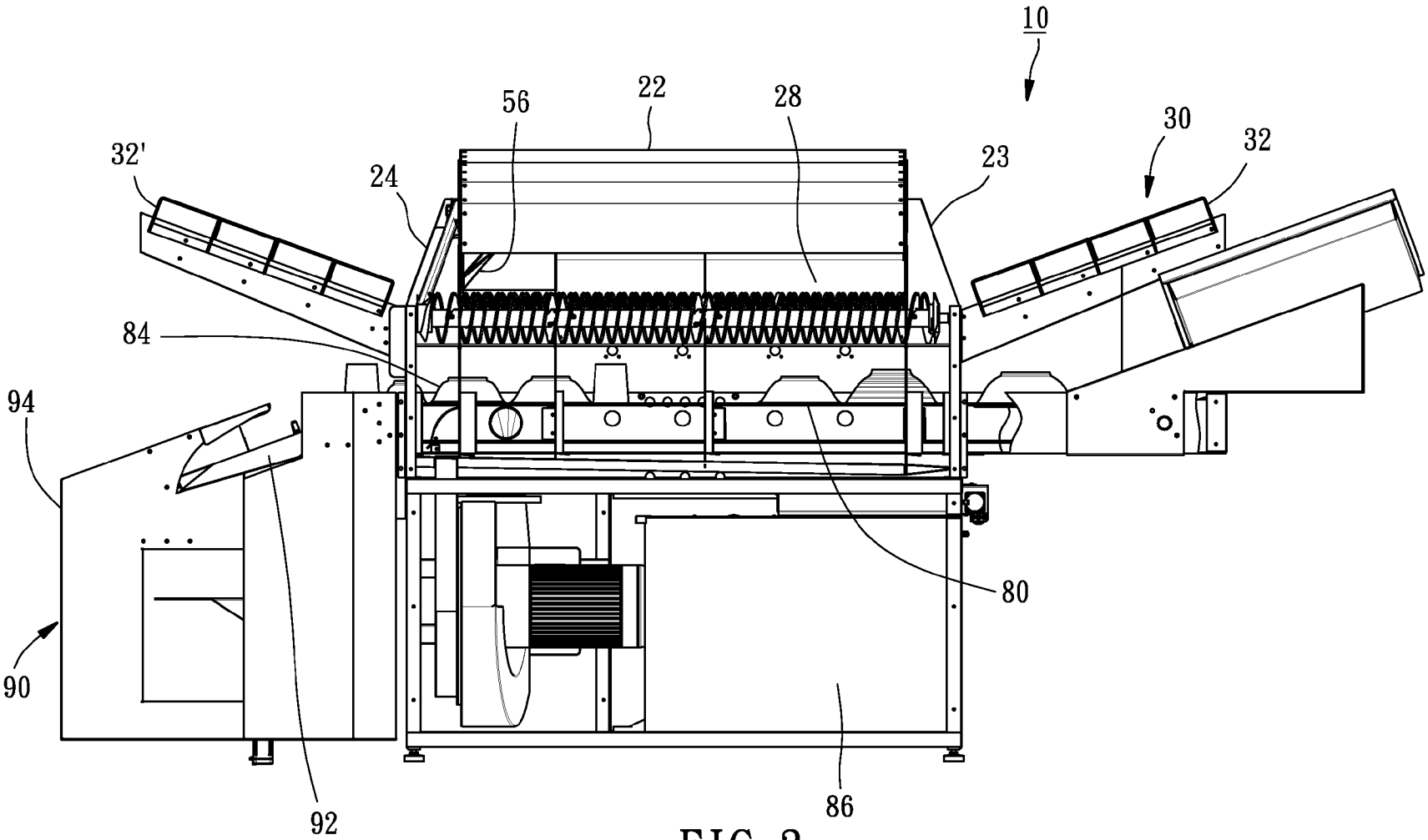
FIG. 3 is a front view of the dishwasher of the preferred embodiment of the present invention in which a sorting device is installed and front covering plates are removed for concise illustrative purpose.
Figure 4:
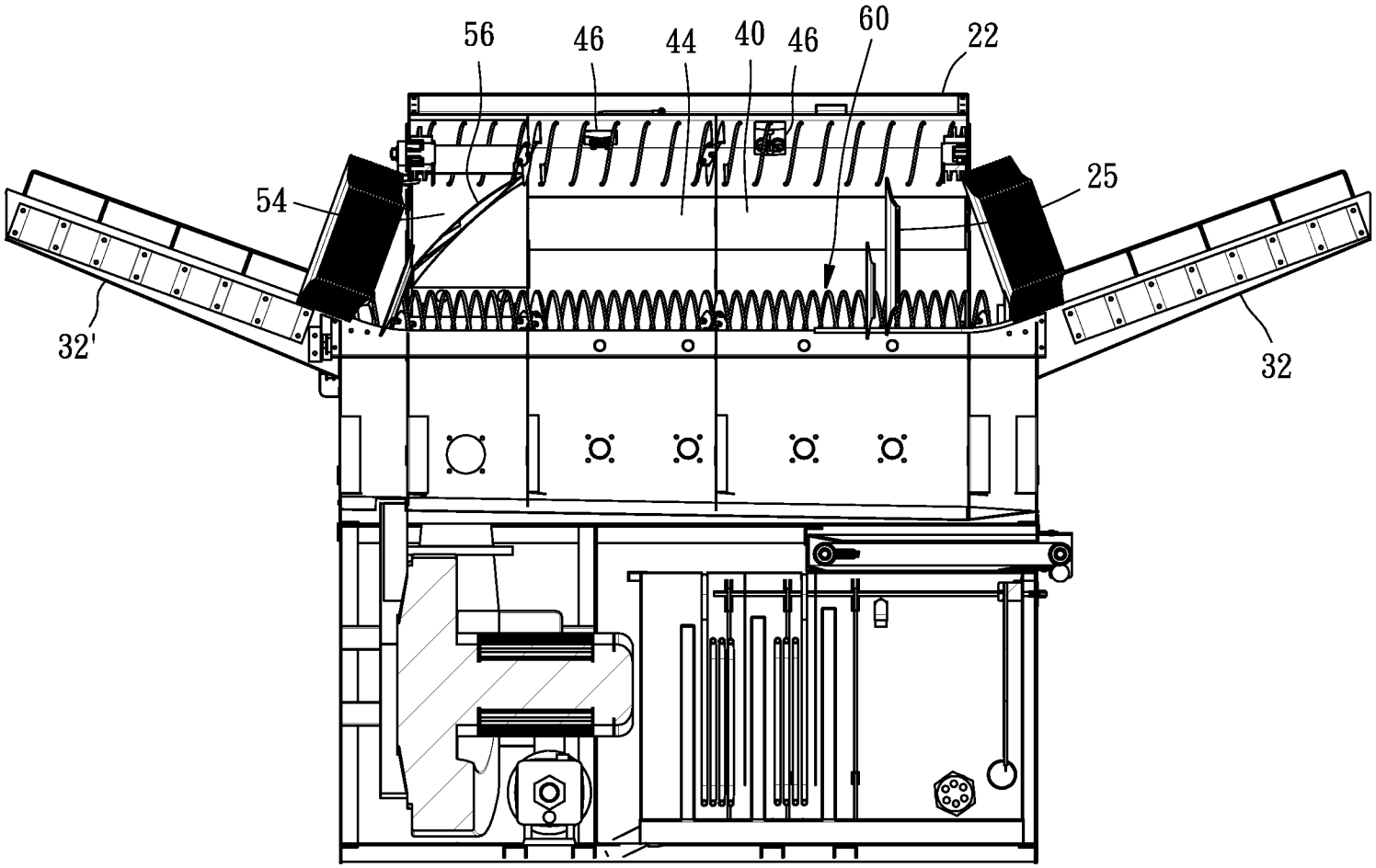
FIG. 4 is a front view of the dishwasher of the preferred embodiment of the present invention in which a cover is view-sectioned to reveal the upper feeding rod-relative to a base of the housing.

Referring to FIGS. 1-4, a dishwasher, denoted by reference numeral 10, employing the dinnerware management system for cleaning dinnerware in accordance with a preferred embodiment of the present invention comprises mainly a housing 20, a dinnerware guiding unit 30 and three feeding units 60, and optionally a sorting device 90 as shown in FIG. 3.

The housing 20 includes a base 21 and a cover 22. The base 21 has a first lateral plate 23 with an entrance 26 through which dishes 25 can move into the housing 20, a second lateral plate 24 with an exit 27 through which the dishes 25 can move out of the housing 20. Between the entrance 26 and the exit 27 a passage 28 is formed for the passing of the dishes 25.

Figure 5:
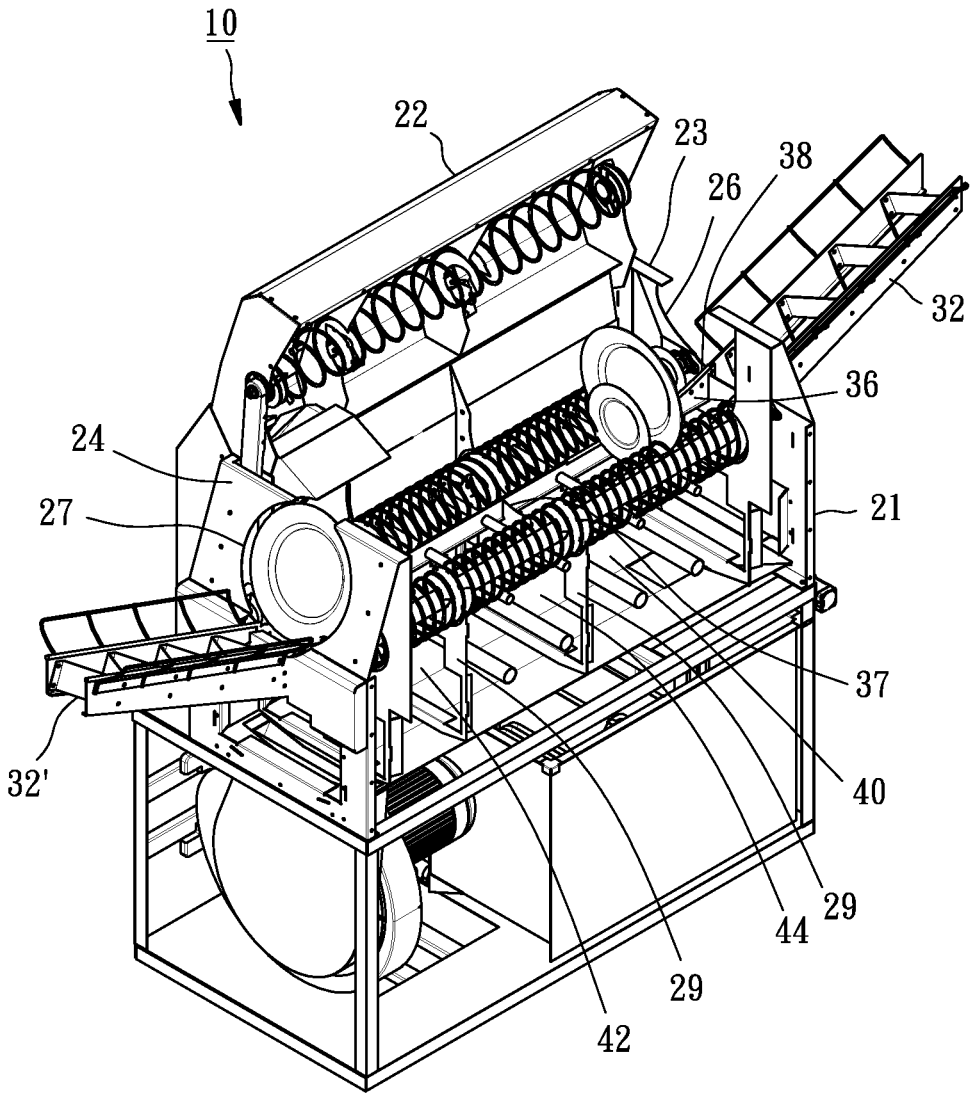
FIG. 5 is another perspective view of the dishwasher of the preferred embodiment of the present invention, showing that the cover is opened relative to the base.

The dinnerware guiding unit 30 includes a first rack 32, a second rack 32' and a central rail 34. The first rack 32 is inclinedly connected with the housing 20 in such a way that the first rack 32 has a first end, namely the inner end, neighbored to the entrance 26 of the housing 20, a second end, namely the outer end, opposite to the first end, and a body extending inclinedly upwardly from the first end to the second end. Similarly, the second rack 32' is inclinedly connected with the housing 20 in such a way that the second rack 32' has a first end, namely the inner end, neighbored to the exit 27 of the housing 20, a second end, namely the outer end, opposite to the first end, and a body extending inclinedly upwardly from the first end to the second end of the second rack 32'. The central rail 34 runs through the entrance 26, the passage 28 and the exit 27 of the housing 20, and as shown in FIG. 5 it comprises a pair of base plates 36, a plurality of reinforced plates 37 and two guide strips 38. The base plates 36 are made of stainless steel plates and spaced from each other at a predetermined distance. Two ends of each reinforced plate 37 are respectively connected with the two base plates 36 such that the reinforced plates 37 are located between the two base plates 36 to reinforce the structure strength of the central rail 34. The guide strips 38 are respectively mounted on the tops of the two base plates 36 and made from polytetrafluoroethylene such that the guide strips 38 are high temperature resistance and acid and alkali resistance, and have a low coefficient of friction, resulting in that dishes can smoothly and easily slide on the guide strips 38 without getting damage.

As shown in FIG. 5, a longitudinal lateral side of the cover 22 is pivotally connected with the base 21 such that the cover 22 is openable relative to the base 21 to expose the passage 28. In the passage 28 of the housing 20 two compartment plates 29 are spacedly arranged to segment the passage 28 into a wash zone 40 in proximity to the entrance 26, a drying zone 42 in proximity to the exit 27, and a rinse zone 44 between the wash zone 40 and the drying zone 42. On the locations of the inner surface of the cover 22, which correspond in location to the wash zone 40 and the rinse zone 44 respectively, a first spray washing unit 46 is mounted for spraying inclinedly cleaning fluid toward the passage 28. In this way, the first spray washing units 46 can be forced to pivotally move along with the cover 22 relative to the base 21.

A drying unit 50 is disposed in the drying zone 42 of the housing 20. The drying unit 50 includes a hot air blower 52 and a conduit 54 which is in communication with the hot air blower 52 and provided with an air outlet 56 inclinedly facing the rail 34 for introducing hot air from the hot air blower 52 to the dishes 25 passing the drying zone 42.

Figure 6:
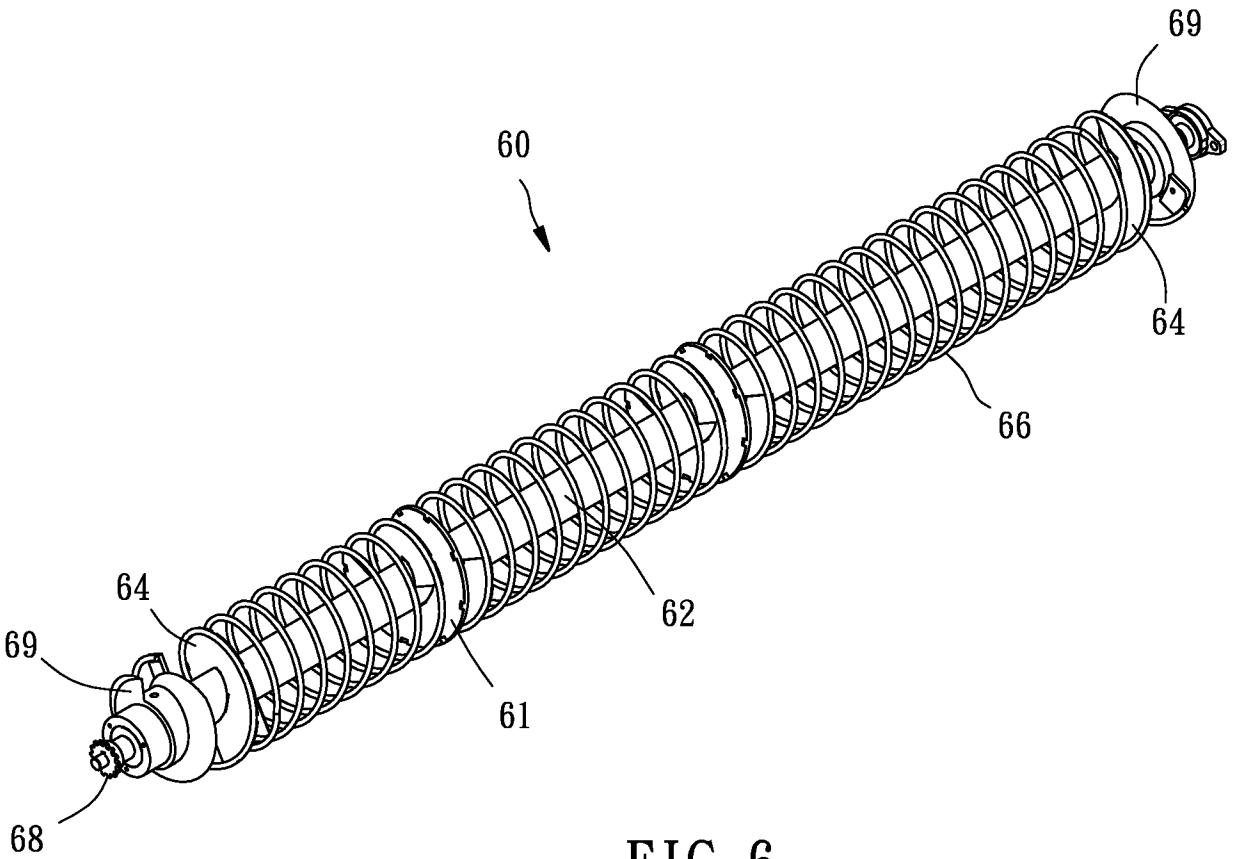
FIG. 6 is a perspective view of the feeding unit of the dishwasher of the preferred embodiment of the present invention.

In this preferred embodiment, each one of the three feeding units 60 comprises a shaft 62, two end caps 64, a helical coil 66 and a sprocket wheel 68. Two of the three shafts 62 of the three feeding units 60 are rotatably connected between the first lateral plate 23 and the second lateral plate 24 and disposed in the passage 28. The other one of the shafts 62 is rotatably arranged inside the cover 22. The axial direction of the shafts 62 are parallel to the extending direction of the rail 34 and the shafts 62 are arranged around the rail 34. As shown in FIG. 6, the two end caps 64 are respectively fixedly connected with the two end of the shaft 62, and each one of the end caps 64 has a helical groove 69. The helical coil 66 has a plurality of turns arranged in a common pitch, and two ends respectively mounted to the end caps 64, such that a helical guide groove 61 having a plurality of compartments with an equal pitch is defined by the helical coil 66. Through a chain (not shown) engaging the sprocket wheel 68 the shaft 62 is rotatable.

Figure 10:
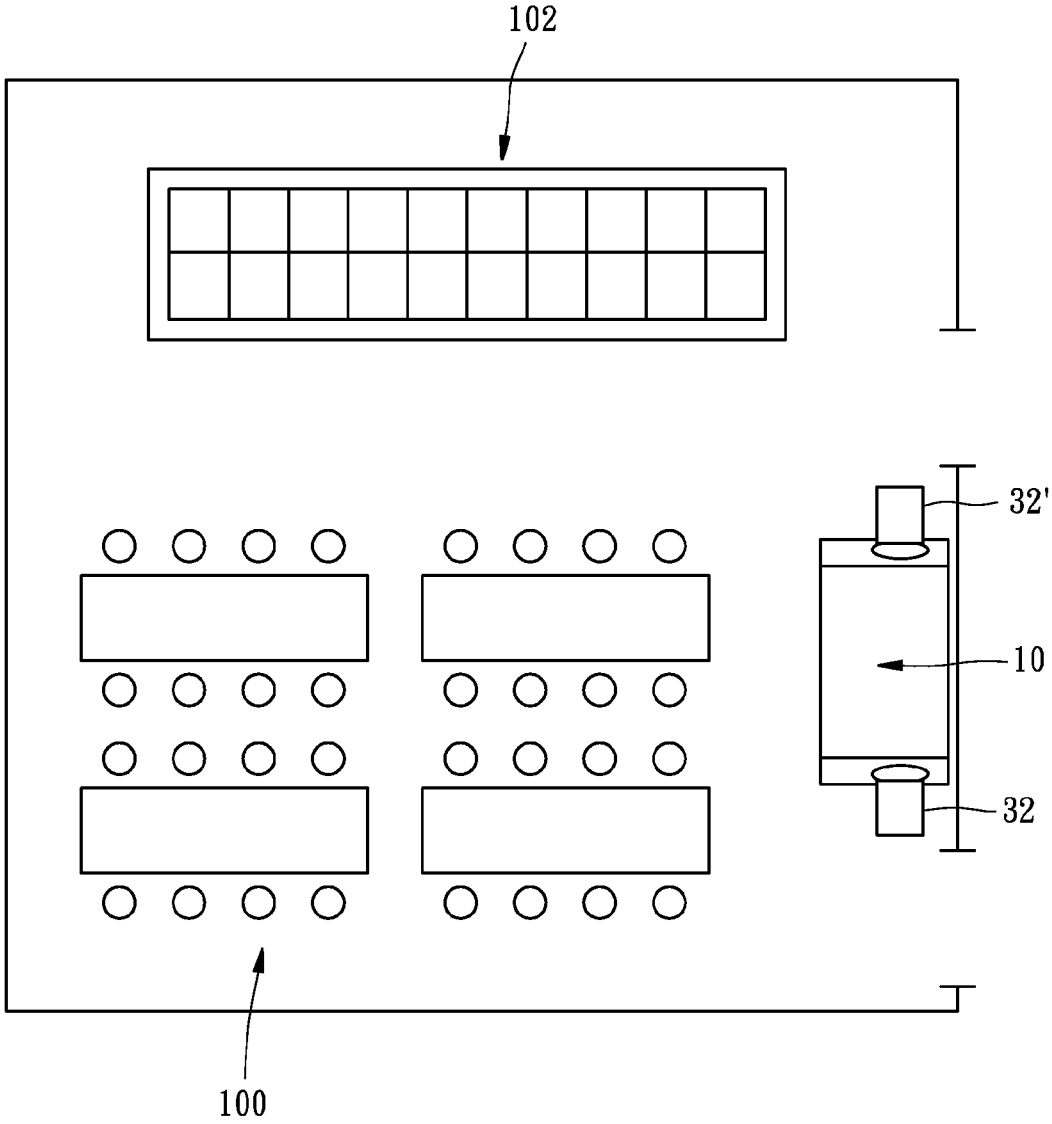
FIG. 10 is a schematic drawing, showing that the dishwasher of the present invention is directly placed at the dining area.
Figure 11:
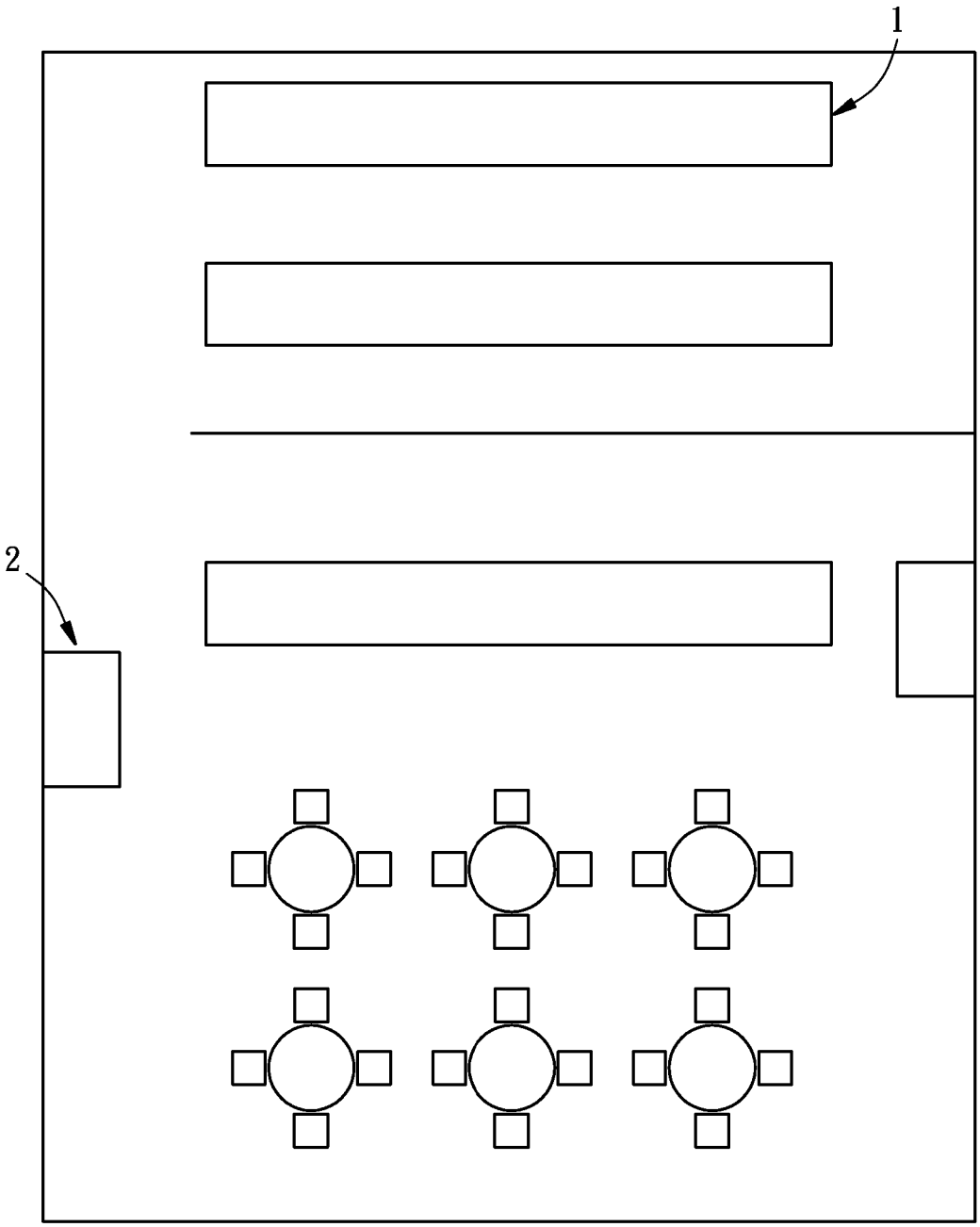
FIG. 11 PRIOR ART
FIG. 11 is a schematic drawing, showing that a dishwasher according to a prior art is placed at a kitchen.

Referring to FIG. 10, the dishwasher 10 of the present invention can be directly placed at a place adjacent to the dining area 100 for conveniently use by the diners in a restaurant. The diner can put the dishes 25 to be cleaned at the standby zone arbitrarily, i.e. the first rack 32. Since the first rack 32 is inclined toward the entrance 26, the dishes 25 to be cleaned at the standby zone will be stacked one after one at the entrance 26. In the meantime, the dish nearest to the entrance 26 will be picked up by the three synchronously rotated helical coils 66 that form a picking-up plane and forced into the passage 28 through the entrance 26. In this way, the dishes 25 placed at the standby zone will be spacedly held one by one in the respective compartments of the helical guide grove 61 and marched forward along a path parallel to the shafts 62 with a to-be cleaned posture, namely an inclined posture or an approximately vertical posture, relative to the path toward the exit 27.

The dishes 25 will thereafter be marched through the wash zone 40, the rinse zone 44 and the drying zone 42 of the passage 28. In the meantime, the first spray washing unit 46 at the wash zone 40 will spray hot/warm cleaning liquid toward the front side and back side of the dishes 25 marching across the wash zone 40 in various directions, such that the front and back sides, including the corners that can not be easily cleaned, of the to-be-cleaned dishes 25 can be completely washed. Thereafter, the first spray washing unit 46 at the rinse zone 44 will spray linearly like water mist on the front side and the back side of the dishes 25 marching across the rinse zone 44 to form a thin film on the surface of the moving dishes 25 so as to rinse the dishes 25 completely. When the dishes 25 are rinsed and then enter the drying zone 42, hot air generated by the hot air blower 52 will be blown inclinedly toward the front side and back side of the dishes 25 marching across the drying zone 42 through the conduit 54 so as to dry the dishes 25.

After the processes of washing, rinsing and drying are completed, the dishes 25 will be forced to leave the passage 28 through the exit 27 into the second rack 32' in a good order ready for reuse for holding food from a food providing area 102 by the diner directly. In the process of washing the dishes 25, in case the dishes 25 need to be taken out of the housing 20, the user can open the cover 22 to force the feeding unit 60 installed at the cover 22 to leave the dishes 25 and then the user can directly take the dishes 25 out from the other two feeding units 60.

Figure 7:
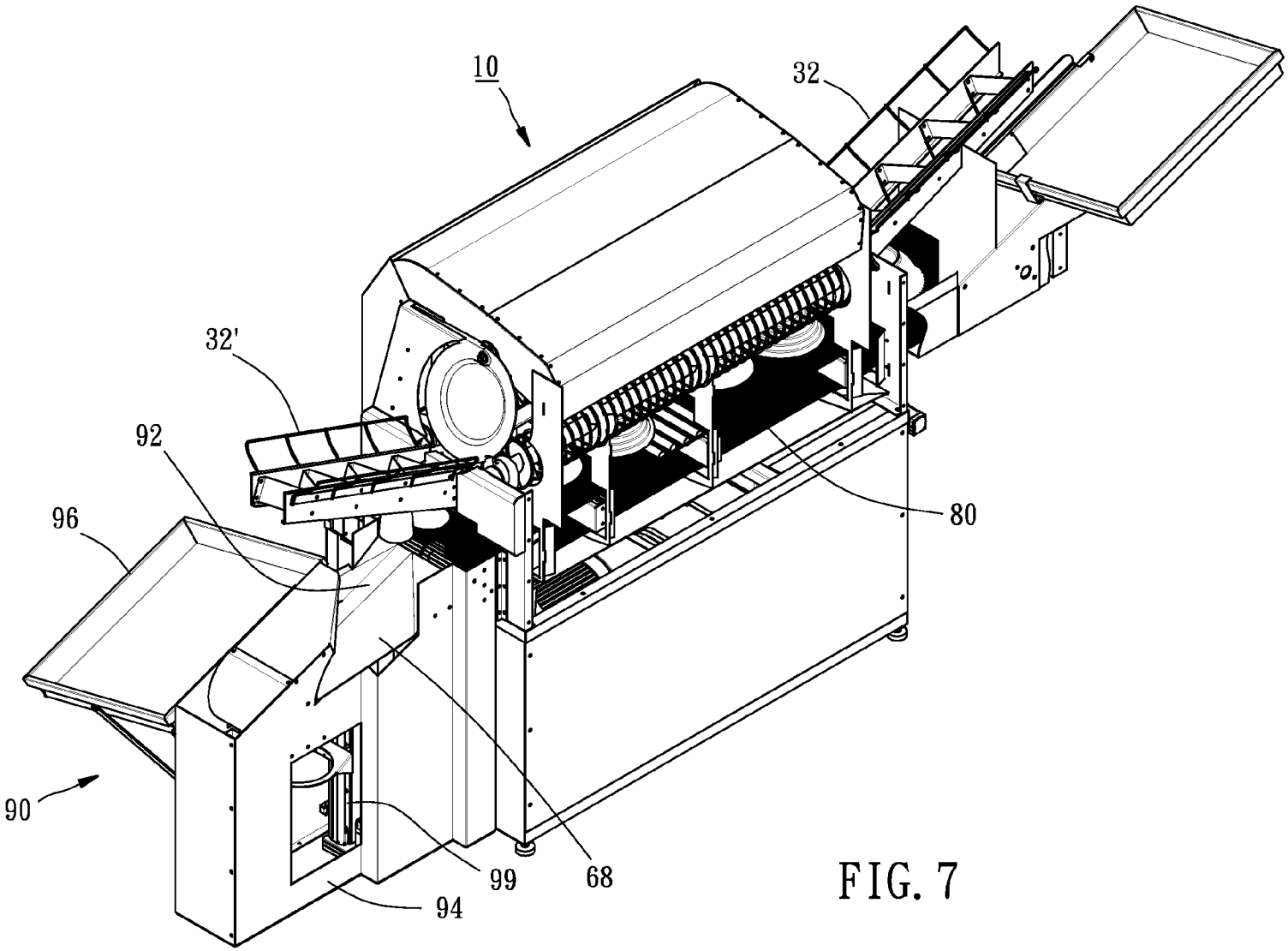
FIG. 7 is a perspective view of the dishwasher of the preferred embodiment of the present invention, showing that the sorting device is installed abutting with the exit of the housing.

In addition, as shown in FIGS. 3 and 7, in order to further clean dining bowls and cups, an endless net conveyer 80 is equipped in the housing 20 and circulated beneath the passage 28, and a plurality of second spray washing units 82 are disposed under the endless net conveyer 80 and can spray cleaning fluid upwardly toward the endless net conveyer 80. Through the entrance 26 the dining bowls 84 to be cleaned can be placed on the endless net conveyer 80 in an upside down manner, such that the dining bowls 84 can be conveyed toward the exit 27 and be cleaned by the cleaning fluid sprayed from the second spray washing units 80 and then dried by the hot air delivered from the conduit 54 during the movement of the dining bowls 84. Further, a water collecting tank 86 is installed in the bottom of the housing 20. The water collecting tank 86 collects filtered wasted water that has been used for cleaning dishes or bowls and separates oil from water so that the water can be recycled used for washing. It contains heat exchanger that can recover the heat energy from the waste water to the incoming fresh water for rinsing and washing.

Figure 8:
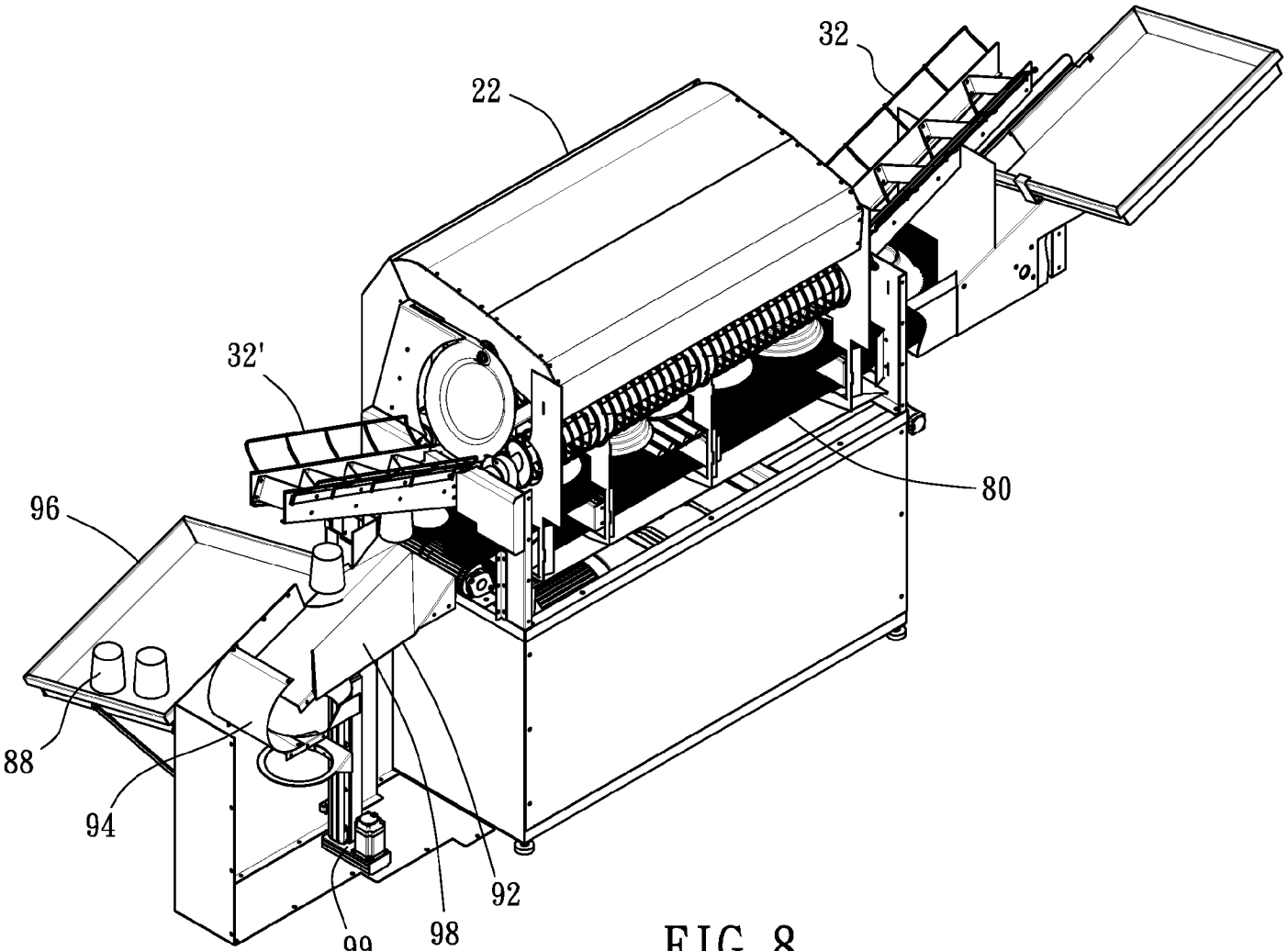
FIG. 8 is a schematic perspective drawing, showing that cleaned cups are sorted and moved to a collection tray/bin.
Figure 9:
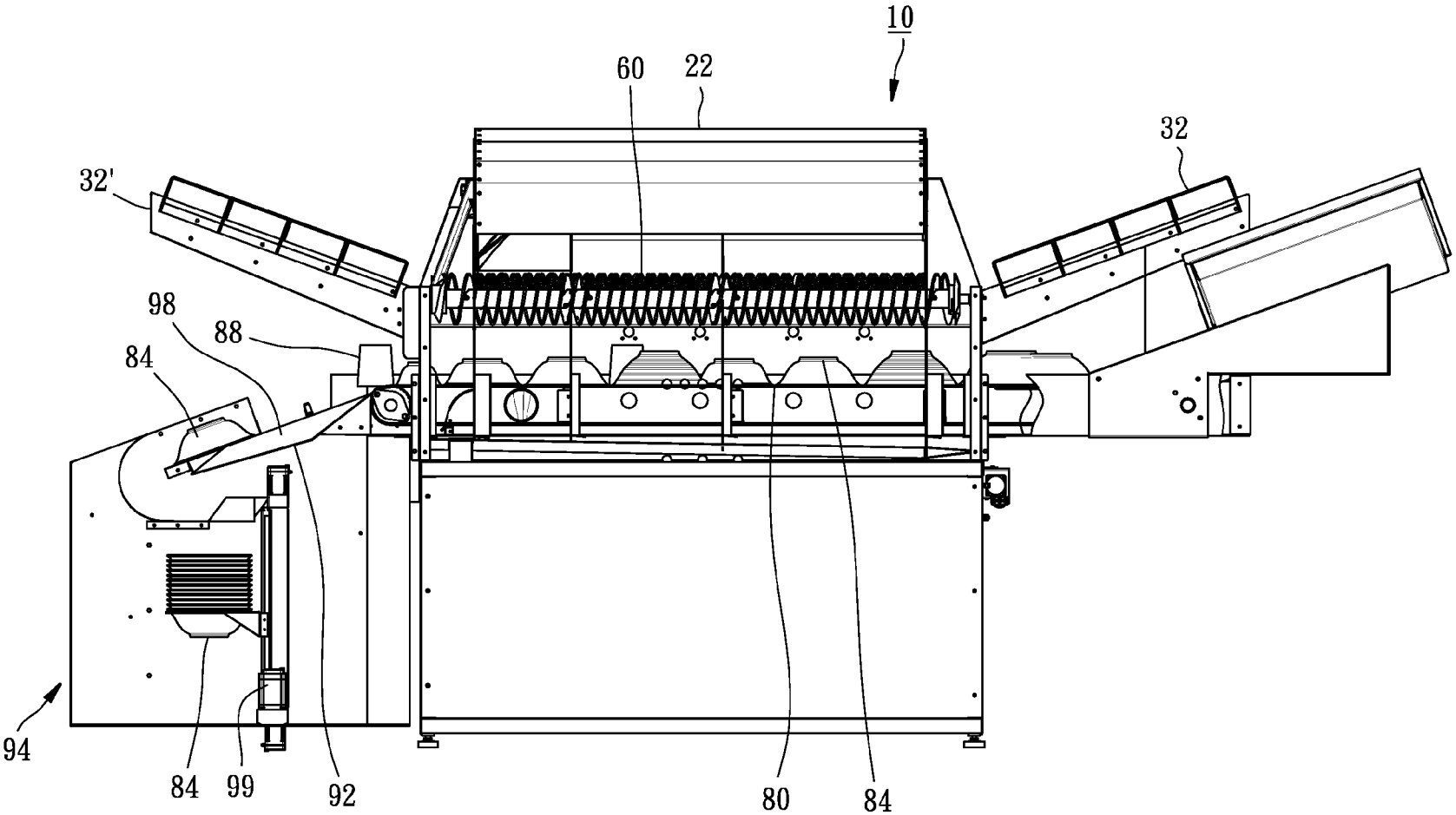
FIG. 9 is a schematic perspective drawing, showing that cleaned dining bowls are sorted and stored.

As shown in FIGS. 7-9, a sorting device 90 can be further set abutting with the exit 27. The sorting device 90 comprises a dispensing member 92, a turning unit 94 and a collection tray/bin 96. The dispensing member 92 has a plurality of grooves 98 or guiding topography configured subject to dining bowls and/or cups having various sizes, such that the dining bowls or cups that have been cleaned and forced to move into the dispensing member 92 can move along a predetermined path to enable the dining bowls to move to the turning unit 94 and the cups 88 to move into the collection tray/bin 96. By means of the design of the tunnel of the turning unit 94, the dining bowls 84 can be turned from the upside down posture to a normal posture and store one after another on the automatic stacker 99.

As indicated above, the dishwasher 10 of the present invention can collect the dishes, dining bowls and cups to be cleaned and then clean and sort the dishes, dining bowls and cups directly, such that using the dishwasher 10 of the present invention can replace the work of transporting the cleaned dinnerware by labor so as to save the labor costs. By means of the design of the feeding unit that employs the rotary helical coil to march the to-be-cleaned dishes, the to-be-cleaned dishes can undergo the washing, rinsing and drying processes in a compact arrangement, such that the dishwasher 10 of the present invention can be designed having a small, compact size. In addition, various dinnerware including dishes 25, dining bowls 84 and cups 88 can be washed in the housing 20 simultaneously and then be collected through the sorting device 90 at an area that is convenient for the diners to take out. In other words, the dishwasher 10 of the present invention is not only multifunctional but also compact in size, so that it is suitable to be directly installed at a location near the diners to enable the diners to grasp the newly cleaned dinnerware at any time. By using the dishwasher 10 of the present invention having a good cleaning efficiency, the operating way and disadvantages of the conventional dishwashers can be improved and the operating costs including the rent for space and the cost of equipment can be lowered.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dishwasher for cleaning dinnerware, comprising:

a stand-by zone for items to be cleaned that provides self-aligning and/or registering the items to be cleaned;

a housing having an entrance, an exit and a passage between the entrance and the exit;

a rail passing through the entrance, the passage and the exit; and at least one feeding unit defining an axial direction parallel to the rail and having a helical guide groove extending in the axial direction, the at least one feeding unit being rotatably disposed in the passage;

the feeding unit comprising means for moving the items continuously one by one from the stand-by zone into a wash zone;

means for washing the items processionally; and an endless net conveyor disposed in the housing and circulating beneath the passage, and a plurality of second spray washing units disposed beneath the endless net conveyor.

2. The dishwasher as claimed in claim 1, wherein the feeding unit comprises a shaft having two ends rotatably connected with the housing such that the shaft is disposed in the passage and defines the axial direction, and a helical coil wound around the shaft and defining the helical guide groove.

3. The dishwasher as claimed in claim 2, wherein the dishwasher comprises three said feeding units, which are parallel arranged around the rail.

4. The dishwasher as claimed in claim 3, wherein the housing comprises a base and a cover pivotally connected with the base and openable relative to the base to expose the passage; one of said feeding units is rotatably mounted to the cover in a way that the one of said feeding units corresponds in location to the passage when the cover is closed on the base.

5. The dishwasher as claimed in claim 1, wherein the housing comprises two compartment plates spacedly disposed in the passage such that the passage is segmented into a wash zone in proximity to the entrance, a drying zone in proximity to the exit, and a rinse zone between the wash zone and the drying zone; each of the wash and rinse zones is installed with at least one first spray washing unit, and the drying zone is installed with a drying unit.

6. The dishwasher as claimed in claim 5, wherein the drying unit comprises a hot air blower and a conduit which is in communication with the hot air blower and provided with an air outlet inclinedly facing the rail for introducing hot air from the hot air blower to the items passing the drying zone.

7. The dishwasher as claimed in claim 1, further comprising a first rack inclinedly connected with the housing in a way that the first rack has a first end neighbored to the entrance of the housing, a second end opposite to the first end, and a body extending inclinedly upwardly from the first end to the second end, and a second rack inclinedly connected with the housing in a way that the second rack has a first end neighbored to the exit of the housing, a second end opposite to the first end of the second rack, and a body extending inclinedly upwardly from the first end of the second rack to the second end of the second rack.

8. The dishwasher as claimed in claim 1, further comprising a water collecting tank, which is capable of conducting heat exchange and separating oil from water, for collecting filtered waste water and exchanging the heat energy of the filtered waste water to fresh water for washing.

9. A dinnerware management system comprising:

a dishwasher as claimed in claim 1; wherein the items to be cleaned that are used by diners are placed at the stand-by zone abutted with the entrance of the dishwasher and cleaned items are collected at a place abutted with the exit of the dishwasher;

a food providing area arranged neighbored to the exit of the dishwasher for enabling the diners to directly take the cleaned items from the dishwasher for holding food in the food providing area, and a dining area arranged between the food providing area and the entrance of the dishwasher for enabling the diners to directly place the items to be cleaned that are used by the diners at the standby zone.

* * * * *